US012716582B2

(12) United States Patent
Iyer et al.

(10) Patent No.: US 12,716,582 B2
(45) Date of Patent: Aug. 25, 2026

(54) PROCESS BURNER WITH DISTAL FLAME HOLDER

(71) Applicant: ClearSign Technologies Corproation, Tulsa, OK (US)

(72) Inventors: Venkatesh Iyer, Bothell, WA (US); Jeff Lewallen, Broken Arrow, OK (US); Colin James Deller, Tulsa, OK (US)

( * ) Notice: Subject to any disclaimer, the term of this patent is extended or adjusted under 35 U.S.C. 154(b) by 360 days.

(21) Appl. No.: 18/465,099

(22) Filed: Sep. 11, 2023

(65) Prior Publication Data

US 2024/0110699 A1 Apr. 4, 2024

Related U.S. Application Data

(63) Continuation of application No. PCT/US2022/071145, filed on Mar. 14, 2022.

(60) Provisional application No. 63/178,194, filed on Apr. 22, 2021, provisional application No. 63/160,682, filed on Mar. 12, 2021.

(51) Int. Cl.
*F23C 9/00* (2006.01)
*F23D 14/02* (2006.01)
*F23D 14/26* (2006.01)

(52) U.S. Cl.
CPC ..... *F23D 14/02* (2013.01); *F23C 9/00* (2013.01); *F23D 14/26* (2013.01); *F23C 2202/20* (2013.01); *F23C 2202/30* (2013.01); *F23C 2900/9901* (2013.01); *F23D 2203/007* (2013.01); *F23D 2203/102* (2013.01)

(58) Field of Classification Search
CPC .... F23D 14/02; F23D 14/26; F23D 2203/007; F23D 2203/102; F23C 9/00; F23C 2202/20; F23C 2202/30; F23C 2900/9901
USPC ..... 431/8
See application file for complete search history.

(56) References Cited

U.S. PATENT DOCUMENTS

| | | | | |
|---|---|---|---|---|
| 4,559,006 | A * | 12/1985 | McGill | F23G 7/085 431/29 |
| 5,224,851 | A * | 7/1993 | Johnson | F23L 7/002 431/207 |
| 5,655,899 | A * | 8/1997 | Hura | F23C 6/047 431/174 |
| 5,813,849 | A | 9/1998 | Schwartz et al. | |
| 5,993,196 | A | 11/1999 | Young et al. | |
| 9,267,686 | B1 * | 2/2016 | Little | F23G 5/50 |
| 2008/0206693 | A1 | 8/2008 | Lifshits et al. | |
| 2010/0252776 | A1 * | 10/2010 | Farmayan | F23C 9/00 431/4 |

(Continued)

FOREIGN PATENT DOCUMENTS

JP 5716531 B2 11/2014

OTHER PUBLICATIONS

Extended European Patent Search Report for European Patent Application No. 22768244.0 mailed Jan. 29, 2025, Jan. 29, 2025.

(Continued)

*Primary Examiner* — Avinash A Savani
(74) *Attorney, Agent, or Firm* — Crowe & Dunlevy, P.C.

(57) ABSTRACT

According to an embodiment, a burner system provides a flow of premixed fuel and flue gas, and combustion airflow is provided at an intended distal flame front position. The burner system may include a pilot burner. A burner system may include a pre-mix pilot burner. In an embodiment a main fuel may include a high hydrogen content.

55 Claims, 13 Drawing Sheets

(56) References Cited

U.S. PATENT DOCUMENTS

| | | | | |
|---|---|---|---|---|
| 2016/0245509 | A1* | 8/2016 | Karkow | F23G 7/08 |
| 2020/0224873 | A1 | 7/2020 | Karkow et al. | |
| 2020/0240628 | A1 | 7/2020 | Deller et al. | |

OTHER PUBLICATIONS

PCT International Search Report, dated Aug. 31, 2022, for PCT International Patent Application No. PCT/US2022/071145, filed Mar. 14, 2022.

PCT Written Opinion of the International Searching Authority, dated Aug. 31, 2022, for PCT International Patent Application No. PCT/US2022/071145, filed Mar. 14, 2022.

Communication Pursuant to Article 94(3) EPC dated Nov. 24, 2025 in related European Application No. 22768244.0.

* cited by examiner

PROCESS BURNER WITH DISTAL FLAME HOLDER

CROSS REFERENCE TO RELATED APPLICATIONS

The present application is a U.S. Continuation application which claims priority benefit under 35 U.S.C. § 120 of International PCT Patent Application No. PCT/US2022/071145, entitled "PROCESS BURNER WITH DISTAL FLAME HOLDER", filed Mar. 14, 2022; which claims priority benefit from U.S. Provisional Patent Application No. 63/178,194, entitled "PROCESS BURNER WITH DISTAL FLAME HOLDER," filed Apr. 22, 2021, and U.S. Provisional Patent Application No. 63/160,682, entitled "BURNER SYSTEM WITH PRE-MIXED DISTAL PILOT," filed Mar. 12, 2021. Each of the foregoing applications, to the extent not inconsistent with the disclosure herein, are incorporated by reference.

SUMMARY

According to an embodiment, a burner system includes a first gas conduit defining a first inlet, a second inlet, and a first outlet, arranged to convey a first gas mixture, in part, from the first inlet proximal to a furnace floor and, in part, from the second inlet above the furnace floor to the first outlet in a furnace volume distal from the first and second inlets. A second gas conduit defines a third inlet and a second outlet, arranged to convey a second gas mixture different from the first gas mixture from the third inlet to the second outlet distal from the third inlet and adjacent to the first outlet. A distal flame holder is aligned to receive the first and second gas mixtures from the first and second gas conduits. A distal pilot burner is configured to output a pilot flame toward the distal flame holder. The first gas mixture may include combustion air from a combustion air source. The second gas mixture includes flue gas from the furnace volume. According to embodiments, at least one of the first gas mixture and the second gas mixture includes a gaseous fuel. The first and second outlets from the first and second gas conduits may be aligned to cause the first and second gas mixtures to mix near the distal flame holder. The pilot burner may be configured to output the pilot flame to initiate and guarantee ignition of at least the first gas mixture to support a main combustion reaction held by the distal flame holder.

According to an embodiment, a burner system includes a pre-mix pilot burner disposed in a furnace at a distal position along a main fuel and combustion air flow axis and one or more main fuel nozzles disposed at a proximal position along the main fuel and combustion air flow axis. The pilot burner is configured to support a pilot flame. The one or more main fuel nozzles are configured to support a main flame in contact with the pilot flame. The pilot burner is disposed to cause the main fuel and combustion air to be ignited by the pilot flame.

According to an embodiment, a burner system includes a main fuel source disposed at a proximal position along a flow axis of a furnace, a pre-mix pilot burner disposed at an intermediate distance along the flow axis, and a distal flame holder disposed at a distal position along the flow axis. The pilot burner may be configured to support a pilot flame to initiate and maintain combustion of the main fuel. The main fuel source is configured to provide main fuel to the distal flame holder. The distal flame holder is configured to hold at least a portion of a combustion reaction supported by the main fuel.

According to an embodiment, a method for operating a burner system includes providing heat to a distal flame holder from a pilot flame supported by a pre-mix pilot burner, the pilot flame being fueled by a pilot fuel, the distal flame holder and the pilot burner being disposed in a furnace and in proximity to one another, the pilot burner disposed between the distal flame holder and one or more main fuel nozzles, a distance between the pilot burner and the distal flame holder being smaller than a distance between the pilot burner and the one or more main fuel nozzles. Mixed main fuel and air are introduced to the distal flame holder. The method includes holding at least a portion of a combustion reaction of the mixed main fuel and air with the distal flame holder while the pilot burner continues to support the pilot flame.

According to an embodiment, a burner system includes a pre-mix pilot burner disposed in a furnace at a distal position adjacent to a main fuel and flue gas flow axis, one or more main fuel nozzles disposed at a proximal position along the main fuel and flue gas flow axis, and a combustion air source disposed to provide combustion air at the distal position. The distal position is sufficiently far away from the proximal position that the main fuel and flue gas are completely mixed during flow between the proximal and distal positions. The pilot burner is configured to support a pilot flame using a pre-mixture of a pilot fuel and an oxidant. The one or more main fuel nozzles are configured to output a main fuel to flow from the proximal position to the distal position along the main fuel and flue gas flow axis. The pilot flame is aligned to initiate ignition of the main fuel and the combustion air where the main fuel and combustion air reach an intended distal flame front position. The pilot burner is disposed to support the pilot flame at the intended distal flame front position.

According to an embodiment, a burner system includes a main fuel source disposed at a proximal position along a direction of a flow axis of a furnace, a pilot burner disposed at an intermediate distance along the direction of the flow axis, and a distal flame holder disposed at a distal position along the direction of the flow axis. The pilot burner is configured to receive a pre-mixture of a pilot fuel and an oxidant to support a pilot flame to heat the distal flame holder. The main fuel source is configured to provide main fuel to the distal flame holder. The distal flame holder is configured to hold at least a portion of a combustion reaction supported by the main fuel.

According to an embodiment, a method for operating a burner system includes providing a pre-mixture of pilot fuel and oxidant to a pilot burner, maintaining a pilot flame at the pilot burner, and igniting a flow including at least main fuel and combustion air with the pilot flame at an intended position distal from one or more main fuel nozzles and a combustion air source.

DETAILED DESCRIPTION

Figure 1A:
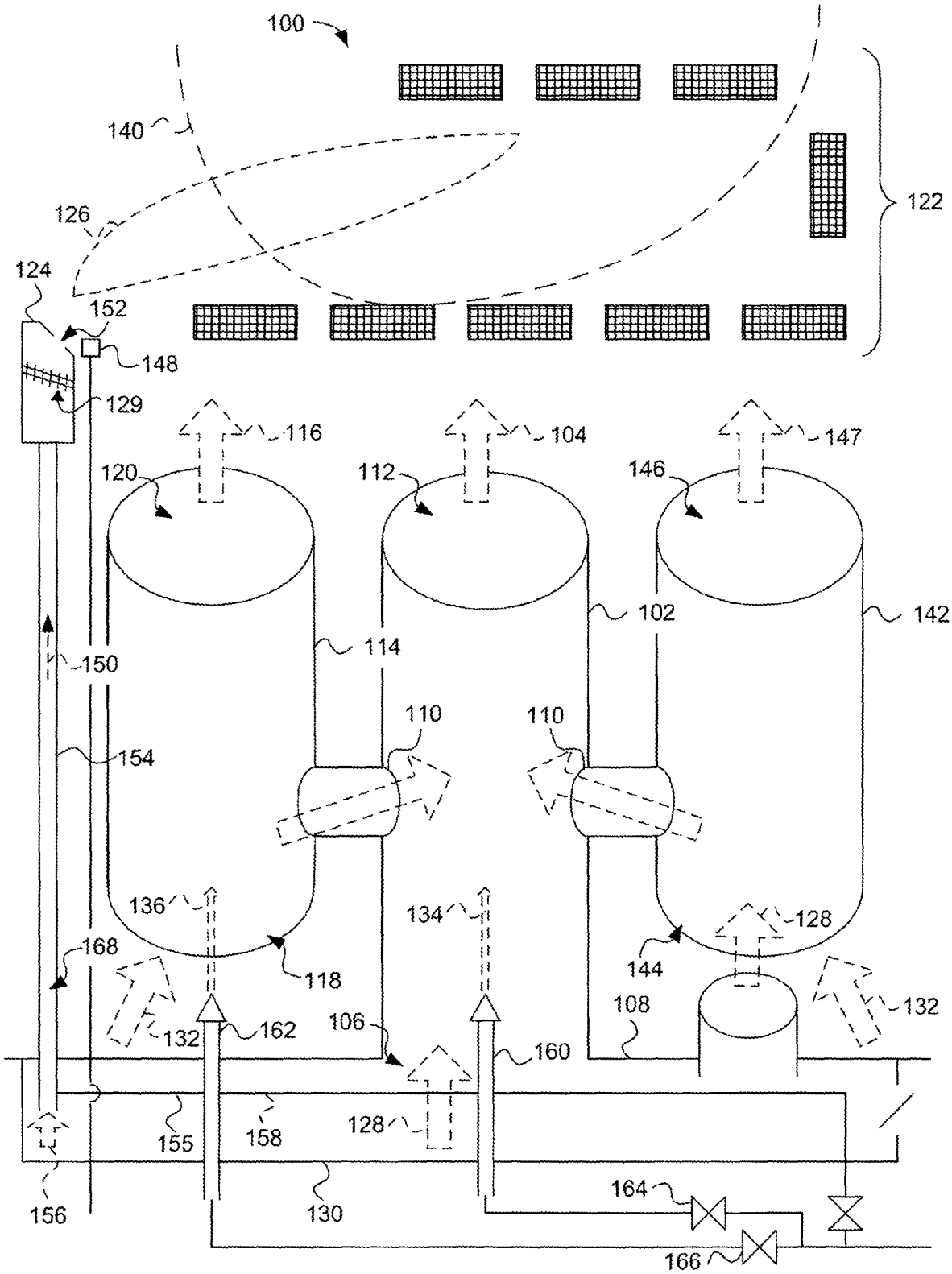
FIG. 1A is a diagram of a burner system, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1A is a diagram of a burner system 100, according to an embodiment. According to an embodiment, the burner system 100 includes a first gas conduit 102, defining a first inlet 106 and a first outlet 112, arranged to convey a first gas mixture 104, at least in part, from the first inlet 106 proximal to a furnace floor 108 to the first outlet 112 in a furnace volume distal from the first inlet 106.

According to an embodiment, the burner system 100 also includes a second gas conduit 114 defining a third inlet 118 and a second outlet 120, arranged to convey a second gas mixture 116 different from the first gas mixture 104 from the third inlet 118 to the second outlet 120 distal from the third inlet 118 and adjacent to the first outlet 112. A distal flame holder 122 may be aligned to receive the first and second gas mixtures 104, 116 from the first and second gas conduits 102, 114. A distal pilot burner 124 may be configured to output a pilot flame 126 toward the distal flame holder 122.

The first gas mixture 104 may include combustion air 128 from a combustion air source 130. The second gas mixture 116 may include flue gas 132 from the furnace volume. At least one of the first gas mixture 104 and the second gas mixture 116 may include a gaseous fuel 134, 136. The first and second outlets 112, 120 from the first and second gas conduits 102, 114 may be aligned to cause the first and second gas mixtures 104, 116 to mix near the distal flame holder 122. The pilot burner 124 may be configured to output the pilot flame 126 to guarantee ignition of a main combustion reaction 140 held by the distal flame holder 122.

According to an embodiment, the first gas conduit 102 is continuous from the first inlet 106 to the first outlet 112 and defines no inlet or outlet other than the first inlet 106 and the first outlet 112. According to another embodiment, the first gas conduit 102 defines a second inlet 110 arranged to allow the second gas mixture 116 to flow from the second gas conduit 114 into the first gas conduit 102. Accordingly, the first and second gas conduits 102, 114 and the operatively coupled second inlet 110 may be configured to cause the first gas mixture 104 to include a portion of the second gas mixture 116 at the first outlet 112.

According to an embodiment, the burner system 100 includes a third gas conduit 142 defining a fourth inlet 144 and a third outlet 146, arranged to convey a third gas mixture 147 from the fourth inlet 144 to the third outlet 146. The third gas mixture 147 may include flue gas 132 and combustion air 128. The third outlet 146 may be disposed to cause the third gas mixture 147 to mix with the first and second gas mixtures 104, 116 near the distal flame holder 122.

In an embodiment, the first gas conduit 102 defines the second inlet 110 arranged to allow the third gas mixture 147 to flow from the third gas conduit 142 into the first gas conduit 102. Accordingly, the first and third gas conduits 102, 142 and the operatively coupled second inlet 110 may be configured to cause the first gas mixture 104 to include a portion of the third gas mixture 147 at the first outlet 112.

According to another embodiment, the second inlet 110 may be formed as a gap defined by the first gas conduit 102, the gap being configured to admit a portion of the second gas mixture 116 and the third gas mixture 147 carried, respectively by the second and third gas conduits 114, 142, into the first gas conduit 102. Accordingly, the first gas mixture 104 may include a fractional portion of the second gas mixture 116 and the third gas mixture 147 where the first gas mixture 104 passes through the first outlet 112 (see, e.g., FIG. 2A).

The burner system 100 may include the combustion air source 130. In some embodiments, the combustion air source 130 may include a combustion air plenum configured to provide natural draft combustion air 128 to the first gas conduit 102. In another embodiment, the combustion air source 130 includes a blower (not shown) configured to provide positive pressure combustion air 128 to the first gas conduit 102.

Various operating regimes are contemplated by the inventors.

In an embodiment, a first fuel nozzle 160 is configured to deliver the first gaseous fuel 134 including less than about 20% hydrogen to the first gas conduit 102. It is believed that delivery of the first gaseous fuel 134 through the first gas conduit 102 when the fuel is less than about 20% hydrogen substantially ensures the main combustion reaction 140 does not blow off the distal flame holder 122.

Other hydrogen concentrations may similarly form limits to operation of the burner system 100. For example, the first fuel nozzle 160 may be configured to deliver the first gaseous fuel 134 including less than about 50% hydrogen to the first gas conduit 102. In another example, the first fuel nozzle 160 may be configured to deliver the first gaseous fuel 134 including less than about 65% hydrogen to the first gas conduit 102.

Corresponding limits to output of the second gaseous fuel 136 may similarly apply. For example, a second fuel nozzle 162 may be configured to deliver the second gaseous fuel 136 including more than about 20% hydrogen to the second gas conduit 114. Additionally or alternatively, the second fuel nozzle 162 may be configured to deliver the second gaseous fuel 136 including more than about 50% hydrogen to the second gas conduit 114. Additionally or alternatively, the second fuel nozzle 162 may be configured to deliver the second gaseous fuel 136 including more than about 65% hydrogen to the second gas conduit 114.

Generally, delivery of the second gaseous fuel 136 through the second gas conduit 114 when the fuel is more than a selected proportion of hydrogen may substantially prevent flashback of the main combustion reaction 140 into the first or second gas conduits 102, 114. This may be understood by reasoning that the configuration of the gas conduits 102, 114 may be selected such that the first gas mixture 104 may be maintained below a lean combustion limit of the relatively high hydrogen fuel 136 insofar as the first gas mixture 104 is mainly combustion air 128, which includes too little fuel to support combustion. Similarly, the second gas mixture 116 may be maintained above the rich combustion limit of the relatively high hydrogen fuel insofar as the second gas mixture includes mainly flue gas 132 and the high hydrogen fuel 136, which provides too little oxygen to support combustion.

The arrangement 100 of the burner system may include one or more first fuel nozzles 160 configured to deliver the first gaseous fuel 134 to the first gas conduit 102, one or more second fuel nozzles 162 configured to deliver a second gaseous fuel 136 to the second gas conduit 114, and respective first and second valves 164, 166 configured to deliver a respective first and/or second gaseous fuel 134, 136 to only one of the first and second fuel nozzles 160, 162 at a time or proportionally to the first and second fuel nozzles 160, 162. The first valve 164 may be opened and the second valve 166 closed to deliver a first gaseous fuel 134 to the first gas conduit 102 when a hydrogen content of the first gaseous fuel 134 is relatively low (according to a threshold selected by a burner configuration engineer). This arrangement may be useful for limiting output of oxides of nitrogen by ensuring that the fuel 160 and combustion air 128 are relatively well mixed by the time the gas mixture 104 is delivered to the flame holder 122. Because hydrocarbon fuels are characterized by relatively low flame speeds, compared to high hydrogen fuels, flashback may be conveniently prevented by maintaining sufficient flow velocity of the gas mixture 104 through the first gas conduit 102. Staged addition of flue gas 132 and, when a third gas conduit 142 is present, combustion air 128 subsequent to an onset of combustion is believed to reduce peak combustion temperature and/or temporally/spatially spread out the combustion reaction 140 across a greater distance.

Additionally or alternatively, the first valve 164 may be closed and the second valve 166 opened to deliver a second gaseous fuel 136 to the second gas conduit 114 when a hydrogen content of the second gaseous fuel 136 is relatively high.

Relatively low hydrogen content may be understood to include when a hydrogen content of the first gaseous fuel 134 is less than 65% hydrogen, less than 50% hydrogen, or less than about 20% hydrogen, with the selected threshold depending on system configuration. Similarly, relatively high hydrogen content may be understood to include when hydrogen content of the second gaseous fuel 136 is greater than 20% hydrogen, greater than 50% hydrogen, or greater than 65% hydrogen, again with the selected threshold depending on system configuration.

According to an embodiment, the distal pilot burner 124 is supplied with a pilot fuel 158 and pilot combustion air 156. The pilot fuel 158 is the same fuel as the gaseous fuel (134 or 136) that is included in the at least one of the first gas mixture 104 and the second gas mixture 116.

According to an embodiment, the pilot fuel 158 supplied to the distal pilot burner 124 may be a different fuel than the gaseous fuel 134, 136 included in the at least one of the first gas mixture 104 and the second gas mixture 116.

The system 100 may further include a pilot burner igniter 148 disposed to ignite the pilot flame 126. According to an embodiment, the distal pilot burner 124 includes a pre-mixed fuel burner configured to output pre-mixed fuel and air 150 through a pre-mixed nozzle 152. The distal pilot burner 124 may include a pre-mixed fuel tube 154 configured to convey the pre-mixture 150 of pilot combustion air 156 and pilot fuel 158 from a pilot combustion air and fuel mixing volume 168 to the pilot burner pre-mix nozzle 152. The pilot fuel 158 may be the same fuel as the first gaseous fuel 134 or may be a different fuel. In one embodiment, for example, the pilot fuel 158 is natural gas and the gaseous fuel 134, 136 is refinery fuel gas including natural gas and hydrogen.

Figure 1B:
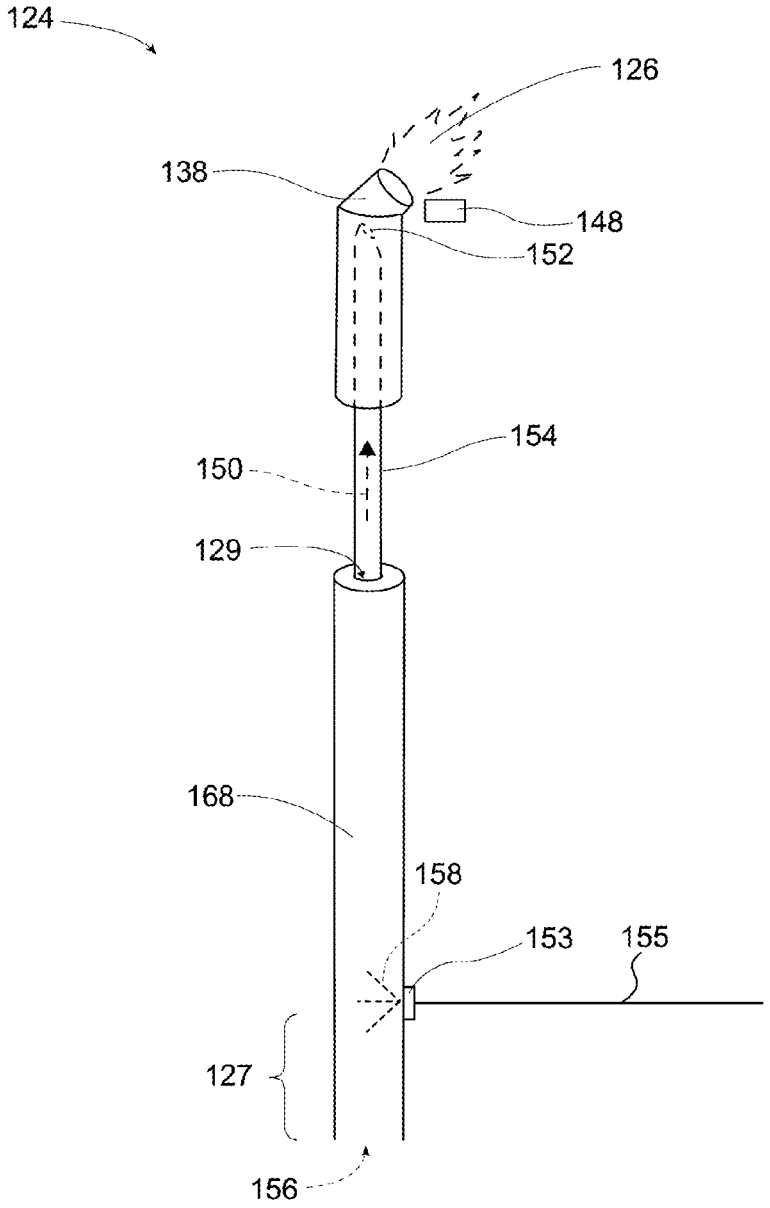
FIG. 1B is a diagram of a pilot burner of a burner system, according to an embodiment.

FIG. 1B illustrates the pre-mix pilot burner 124 of the combustion system 100, according to an embodiment. The pre-mix pilot burner 124 is disposed to output a pilot flame 126 at a distal position, where "distal" and "proximal" are defined as relative locations along a direction parallel to an axis of flow of the first gaseous fuel 134 and combustion air 128 (substantially vertical, in FIG. 1A). The "proximal" position is at or near the furnace floor 108 in FIG. 1A. Referring to FIGS. 1A and 1B, one or more first (or main) fuel nozzles 160 may be disposed at the proximal position. The pilot burner 124 may be configured to support a pilot flame 126 using a pre-mixture 150 of pilot fuel and pilot combustion air, while the one or more main fuel nozzles 160 are configured to support a main combustion reaction 140 in contact with the pilot flame 126. The distal pre-mix pilot burner 124 may be disposed and/or oriented to cause at least the first gas mixture 104 to be ignited by the pilot flame 126 as it traverses the distal flame holder 122. Owing to the flow and mixing of first gaseous fuel 134 and combustion air 128 as the first gaseous fuel and combustion air pass from the proximal position to the distal position, and the position of distal flame holder(s) 122, the main combustion reaction 140 is generally located more distal from the first fuel nozzles 160 than the pilot flame 126, such that the pilot flame 126 and distal flame holders 122 define a flame front (i.e., farthest upstream extent) of the main combustion reaction 140. The distal pilot burner 124 may be disposed to support the pilot flame 126 at an intended distal flame front position.

The pilot fuel 158 may be the same as the first gaseous fuel 134 and/or the second gaseous fuel 136, or of a same fuel type, or each may be distinct and of different types, according to embodiments.

In an embodiment, the pilot burner 124 may include a pilot pre-mixing volume 168, and a pilot fuel line fitting 153 configured to output the pilot fuel 158 received from a pilot fuel line 155 into the pilot pre-mixing volume 168, as well as an oxidant channel configured to output the oxidant into the pilot pre-mixing volume 168. The pilot pre-mixing volume 168 may be configured to mix the pilot fuel 158 and the pilot combustion air 156 to produce the premixture 150 of pilot fuel.

The pilot burner 124 includes a pre-mix fuel nozzle 152 configured to direct the pre-mixture 150 and pilot flame 126 toward an intended distal position. The distal position may be coincident with a distal flame holder 122. The pilot burner 124 may optionally include a flame arrestor 129 disposed between the pilot pre-mixing volume 168 and the pre-mix fuel nozzle 152. In an embodiment, the flame arrestor 129 may be disposed at an output of the pilot pre-mixing volume 168. In another embodiment, the flame arrestor 129 may be disposed between the output of a premixed fuel tube 154 and the pilot pre-mix fuel nozzle 152, as in FIGS. 1A and 1B. In another embodiment, the flame arrestor 129 is omitted and flashback is controlled by maintaining a high mixture velocity from the pilot pre-mixing volume 168 and the pilot nozzle 152. The pilot burner 124 may include a housing having a directional cowl 138 disposed above the output of the pilot nozzle 152.

In an embodiment, the premixed fuel tube 154 may be configured to support the pilot burner 124 at the distal position. In an embodiment, a pilot fuel line 155 may direct the pilot fuel 158 to the pilot fuel line fitting 153. In another embodiment, the premixed fuel tube 154 may direct the premixture of pilot fuel and pilot combustion air 150 from a pre-mix volume (not shown) located outside the furnace to the distal pilot burner assembly 124. An outer support may be configured to substantially prevent wobbling of the premixed fuel tube 154.

A pilot igniter 148 may be configured to ignite the pre-mixture 150 of the pilot fuel 158 and the pilot combustion air 156. The pilot igniter 148 may be disposed downstream from the pre-mix pilot nozzle 152 to ignite the pre-mixture 150 of pilot fuel and pilot combustion air after they exit the pilot pre-mix nozzle 152. The pilot igniter 148 may include a spark generator configured to generate a spark to ignite the pre-mixture 150, or may include a hot surface igniter configured to heat up responsive to application of electrical energy to a temperature equal to or greater than an autoignition temperature of the pre-mixture 150.

The main combustion reaction 140, inside a volume of a furnace may include a flame having a heat output of at least 10 times the heat output of the pilot flame 126 when the burner system 100 is operating at a rated heat output. A rated heat output may correspond to operating in a steady state standard operating mode.

According to an embodiment the pilot burner 124 may be oriented to cause contact of the pilot flame 126 with at least the first gas mixture 104.

According to an embodiment, the pilot burner 124 may be oriented to additionally or alternatively cause contact of the pilot flame 126 with at least one of the second gas mixture 116 and the third gas mixture 147.

According to an embodiment, the first fuel nozzle 160 may be configured to output fuel in co-flow with the combustion air 128, and/or may form a fuel dump plane at the proximal location. The proximal location may be coincident with or near the floor 108 of a furnace.

In an embodiment, the distal flame holder 122 may be fabricated with metal, or entirely from metal, or may consist essentially of metal. In other embodiments, the distal flame holder 122 may include other materials such as ceramic, refractory materials, and the like.

The distal flame holder 122 may include a gutter-type flame holder made of metal, ceramic, or other material. A gutter-type flame holder refers generally to an elongate bluff body. A V-gutter generally refers to a V-shaped elongate bluff body that is oriented with the open side of the V away from a direction of impinging flow. As used herein, it will be understood that the terms gutter, V-gutter, gutter-type flame holder, and elongate bluff body shall be considered synonymous, unless context indicates otherwise. According to an embodiment, the distal flame holder 122 includes a plurality of gutter-type flame holders. For example, see FIGS. 7C and 7D, described below. According to an embodiment, the gutter-type flame holders are formed from silicon carbide or, alternatively, zirconia.

Embodiments of the distal flame holder 122 may include a solid refractory body, a solid ceramic body, and/or a perforated or porous ceramic such as a reticulated ceramic. The distal flame holder 122 may be configured to support a combustion reaction of the fuel and combustion air upstream, downstream, and/or within the distal flame holder 122.

In this embodiment, the pilot combustion air and fuel pre-mix volume 168 may be operable to cause substantially complete mixing of the flow of pilot combustion air 156 and pilot fuel 158. The pre-mix fuel nozzle 152 may be coupled to the pre-mix volume 168 and be configured to support a momentum-regime flame aimed into a region coincident with an intended combustion position, as shown in FIG. 1A. One or more flow disruptors (e.g., elements of the distal flame holder 122) may define a low velocity and/or low pressure zone in the fluid flow channel that act to hold and stabilize the location of a main combustion reaction 140.

Figure 2A:
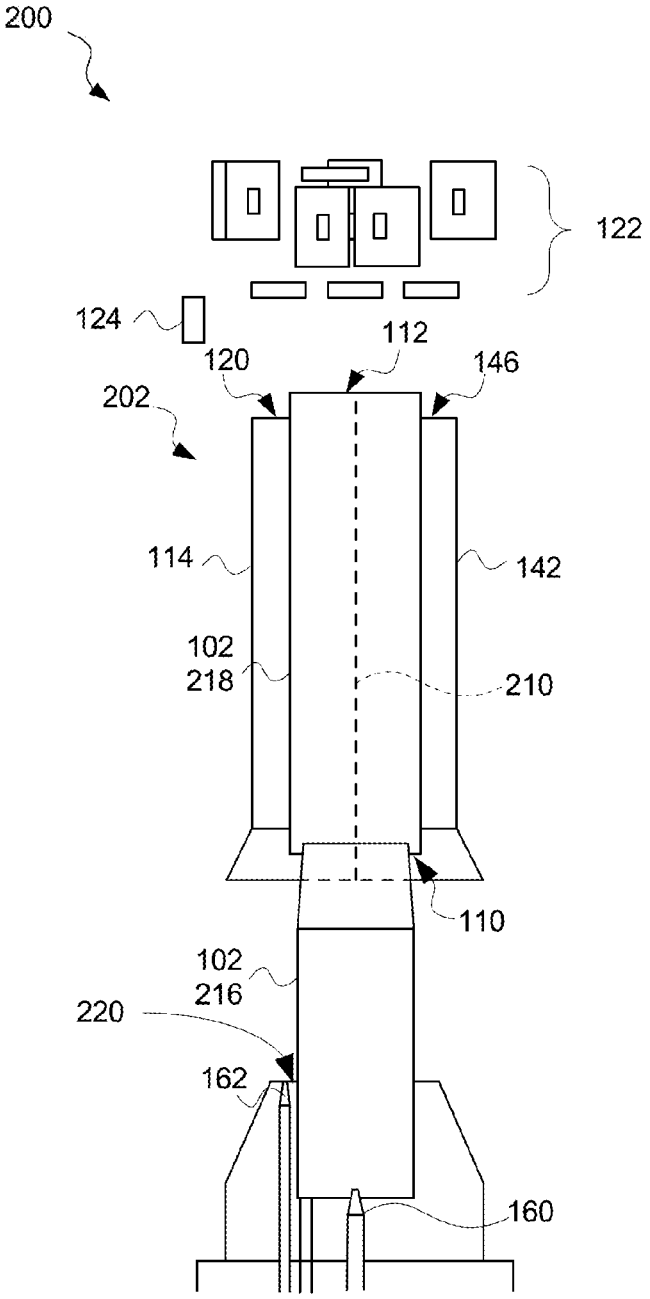
FIG. 2A is a side sectional view of a burner system, according to another embodiment.
Figure 2B:
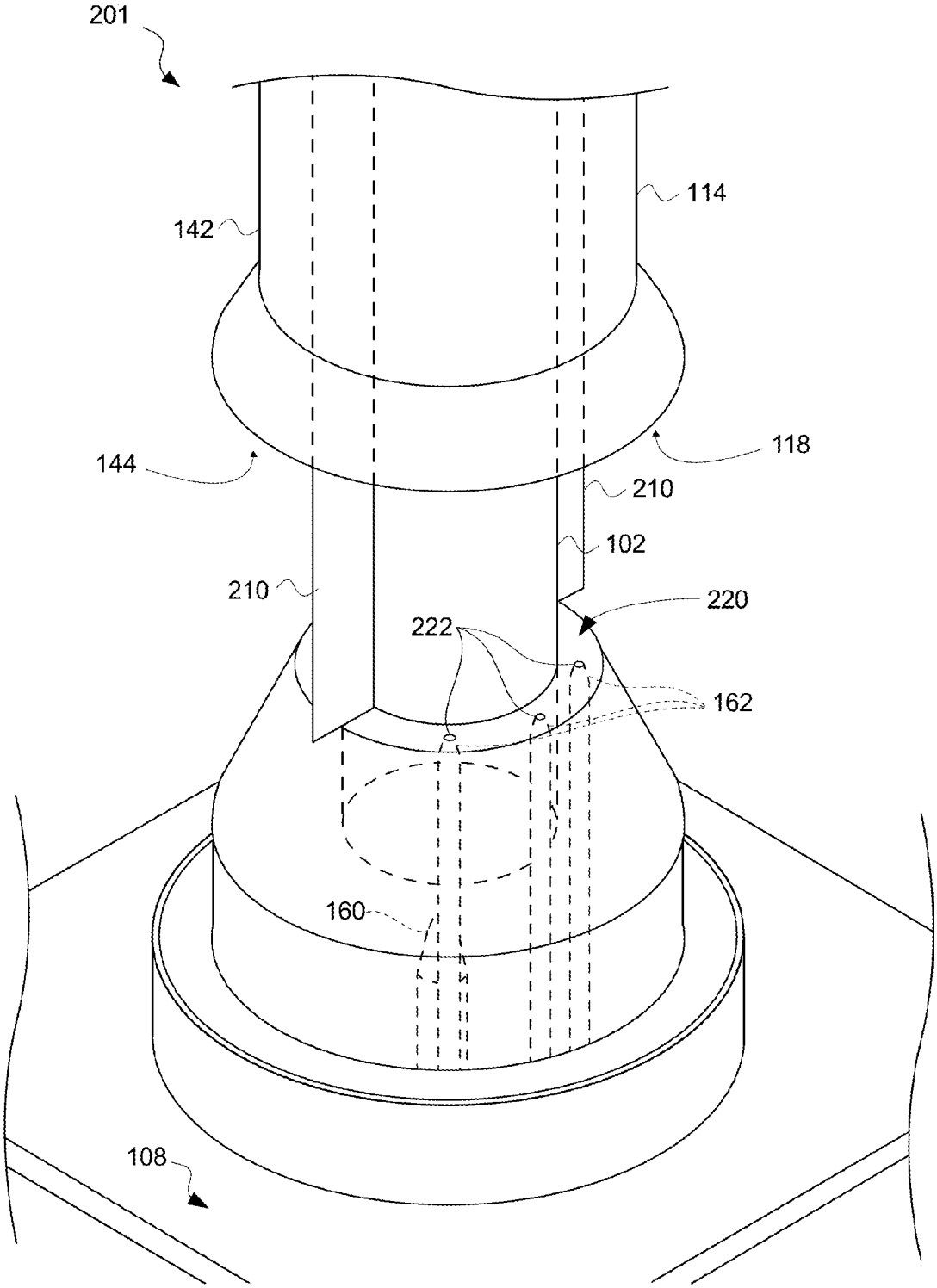
FIG. 2B is a perspective view of a portion of the burner system of FIG. 2A, according to an embodiment.
Figure 2C:
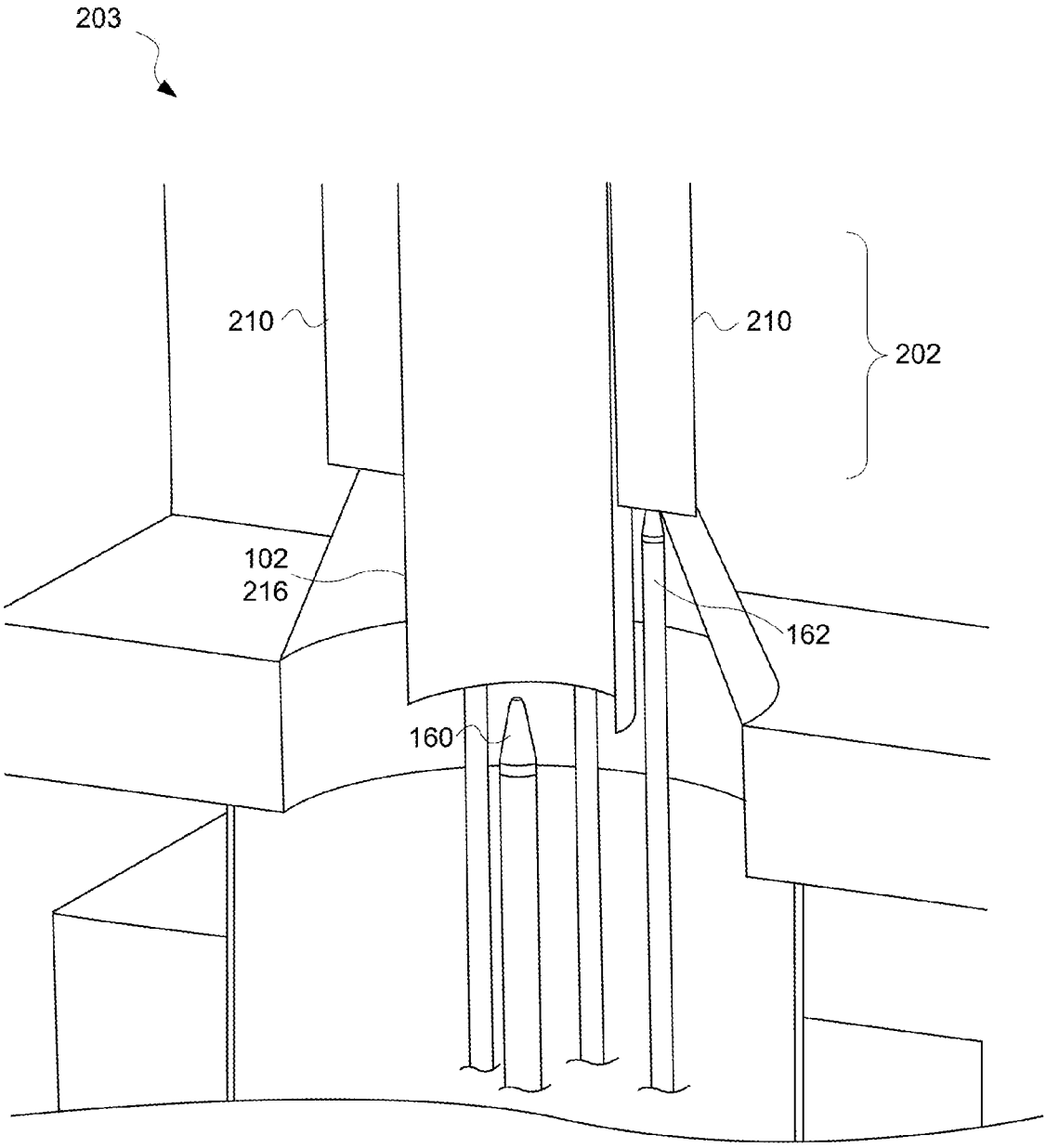
FIG. 2C is a cutaway view of a portion of the burner system of FIGS. 2A and 2B, according to an embodiment.
Figure 3:
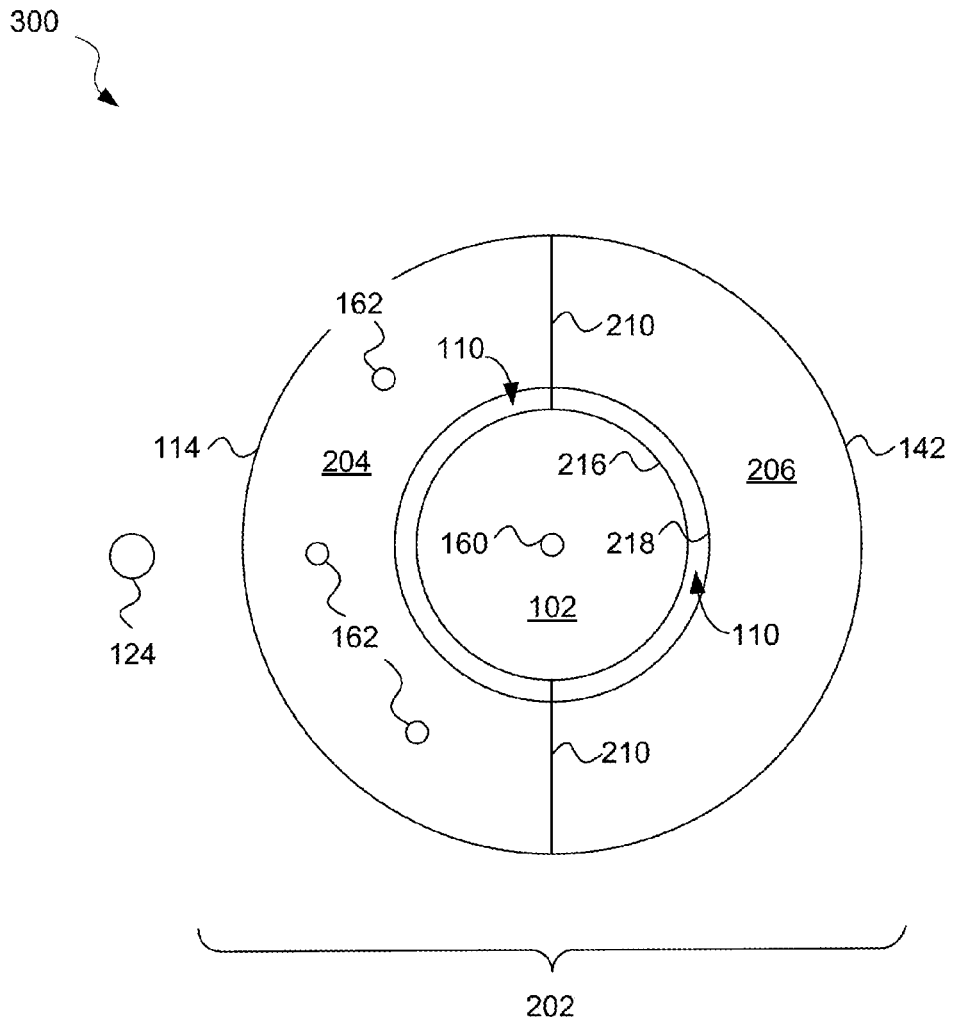
FIG. 3 is a top view diagram of the burner system corresponding to FIGS. 2A-2C, according to an embodiment.

The embodiments of FIGS. 2A, 2B, 2C, and 3 are discussed with reference to FIG. 1A. FIG. 2A is a partial side sectional view of a burner system 200, according to another embodiment. FIG. 2B is a perspective view 201 of a portion of the burner system 200 of FIG. 2A, according to an embodiment. FIG. 2C is a cutaway view 203 of a portion of the burner system 200, 201 of FIGS. 2A and 2B, according to an embodiment. FIG. 3 is a top view diagram of a burner system 300 corresponding to burner systems 200, 201, 203 of FIGS. 2A-2C, according to an embodiment.

The burner systems 100, 200, 201, 203, 300 may include a gas conduit assembly 202 including a first gas conduit 102, second gas conduit 114, and third gas conduit 142, as described above. The first gas conduit 102 may be disposed concentric to a center axis of the conduit assembly 202. The second gas conduit 114 and the third gas conduit 142 may be arranged as respective first and second portions 204, 206 of an annular volume outside of and concentric to the first gas conduit 102, the respective portions of the annular volume 204, 206 being separated by walls 210 running parallel to the center axis from respective third and fourth inlets 118, 144 to at least a majority of the distance to the respective second and third outlets 120, 146. The first gas conduit 102 may form a portion of a wall of the second gas conduit 114 and a portion of a wall of the third gas conduit 142. The first gas conduit 102 may include a proximal portion 216 having a first diameter and a distal portion 218 having a second diameter greater than the first diameter, such that the second inlet 110 may be formed by a gap between the first diameter and the second diameter. In an embodiment, the first diameter may be about nine inches and the second diameter is about ten inches.

In an embodiment, the proximal portion 216 of the first conduit 102 may be about 24 inches long; and the distal portion 218 of the first conduit 102 may be about 36 inches long.

A half-annulus wall 220 may be disposed over a combustion air channel to occlude a combustion air channel and substantially prevent combustion air from entering the second gas conduit 114. The half-annulus wall 220 may define one or more openings 222 corresponding to respective one or more second fuel nozzle(s) 162 or through which the second fuel nozzle(s) 162 may protrude. The one or more openings 222 may be configured to deliver the second gaseous fuel 136 to the second gas conduit 114.

Figure 4:
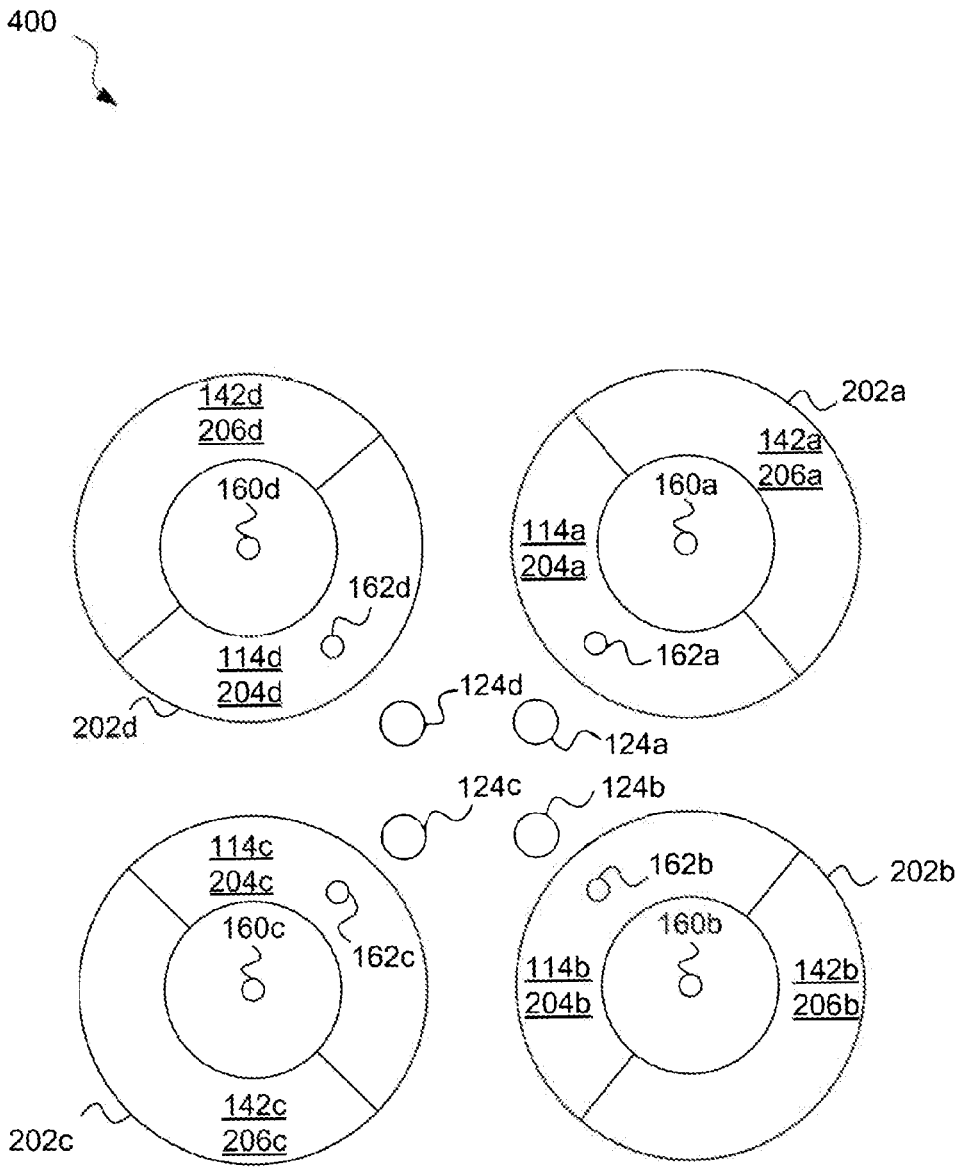
FIG. 4 is a top view diagram of a heater system including a plurality of burner systems of FIGS. 2 and 3, according to an embodiment.

FIG. 4 is a top view diagram of a heater system 400 including a plurality of burner systems similar to the systems described above with reference to FIGS. 2A-2C and 3, according to an embodiment. For convenience of discussing other features of the heater system 400, the distal flame holder 122 is omitted from FIG. 4.

To reiterate, the third gas conduit 142 may form a gas flow area 206 configured to carry a third gas mixture 147 including combustion air 128 and flue gas 132, and to not carry a fuel. A first instance of the burner system 100, 200, 201, 203, 300 may be configured as one of a plurality of instances of burner systems including respective gas conduit assemblies 202*a*, 202*b*, 202*c*, 202*d* disposed in a single furnace volume (e.g., 104, 704) of the heater system 400 and arranged about a central position. According to embodiments, the second gas conduit 114*a*, 114*b*, 114*c*, 114*d* of each gas conduit assembly 202*a*, 202*b*, 202*c*, 202*d* may be oriented toward the central position and other gas conduit assemblies. For example, the second gas conduit 114*a* of a gas conduit assembly 202*a* may be arranged or positioned to be separated from, but generally facing, second instances of the gas conduit assembly 202*b* of the plurality of gas conduit assemblies 202*b*, 202*c*, 202*d*. In other words, the third gas conduit 142*a* may be arranged to be away from the central position and second instances of the gas conduit assemblies 202*b*, 202*c*, 202*d*.

The arrangement of the second gas conduit 114*a* to be oriented away from a second instance of the second gas conduit 114*b*, 114*c*, 114*d* may cause the main combustion reaction 140 for a gas conduit assembly 202*a* to be directed away from other instances of burner systems and gas conduit assemblies 202*b*, 202*c*, 202*d*, and correspondingly, from other instances of main combustion reactions. Directing the main combustion reactions away from one another may result in relatively low output of oxides of nitrogen from the heater system 400.

Figure 5:
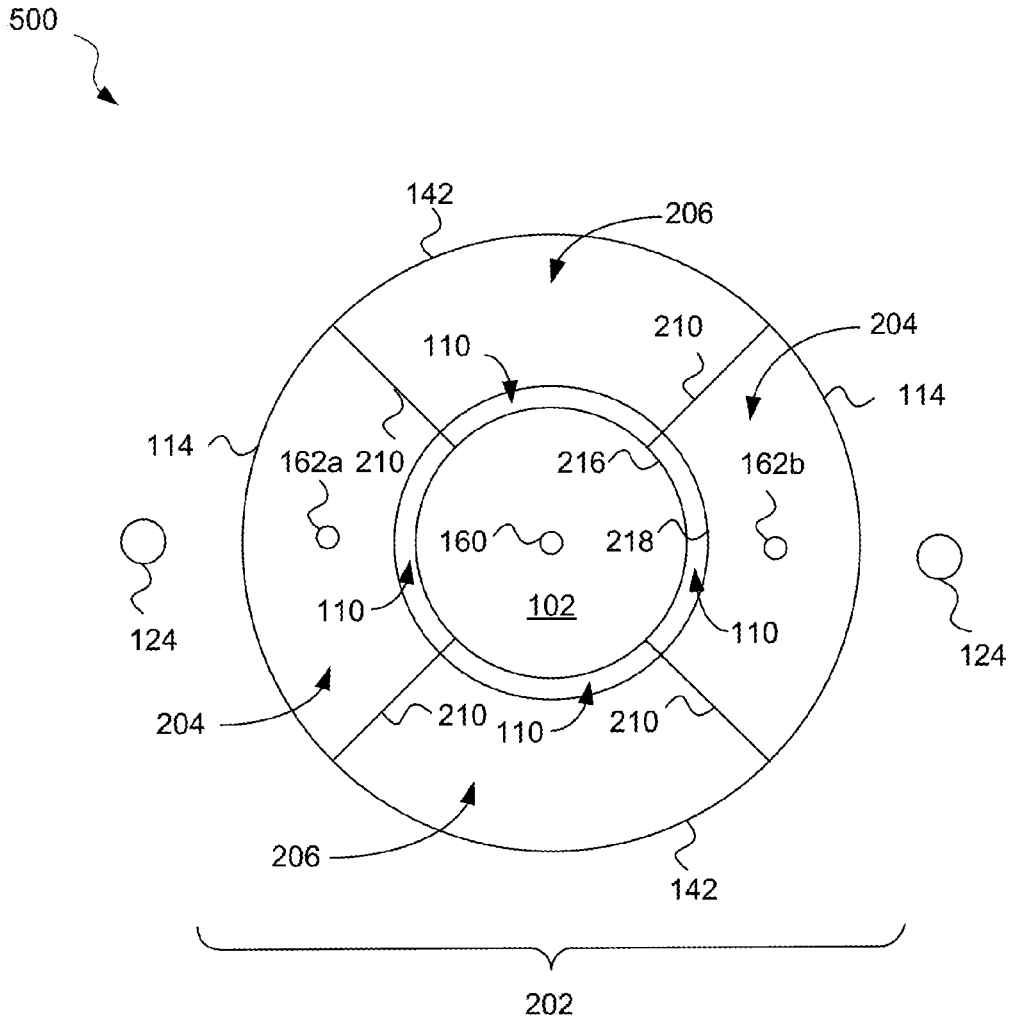
FIG. 5 is a top view diagram of a burner system, according to another embodiment.

FIG. 5 is a top view diagram of a burner system 500, according to another embodiment. A distal flame holder is omitted for convenience in discussing the other structural features. In the embodiment 500, an arrangement of second gas conduits 114 and third gas conduits 142 may include two gas conduits 114, and two third gas conduits 142. The second and third gas conduits 114, 142 may be disposed in an alternating arrangement around the first gas conduit 102, thereby providing four respective gas flow channels 204 and 206. The second and third gas conduits 114, 142 may be created by including four walls 210 dividing the four gas flow channels 204, 206, as shown in FIG. 5.

Figure 6:
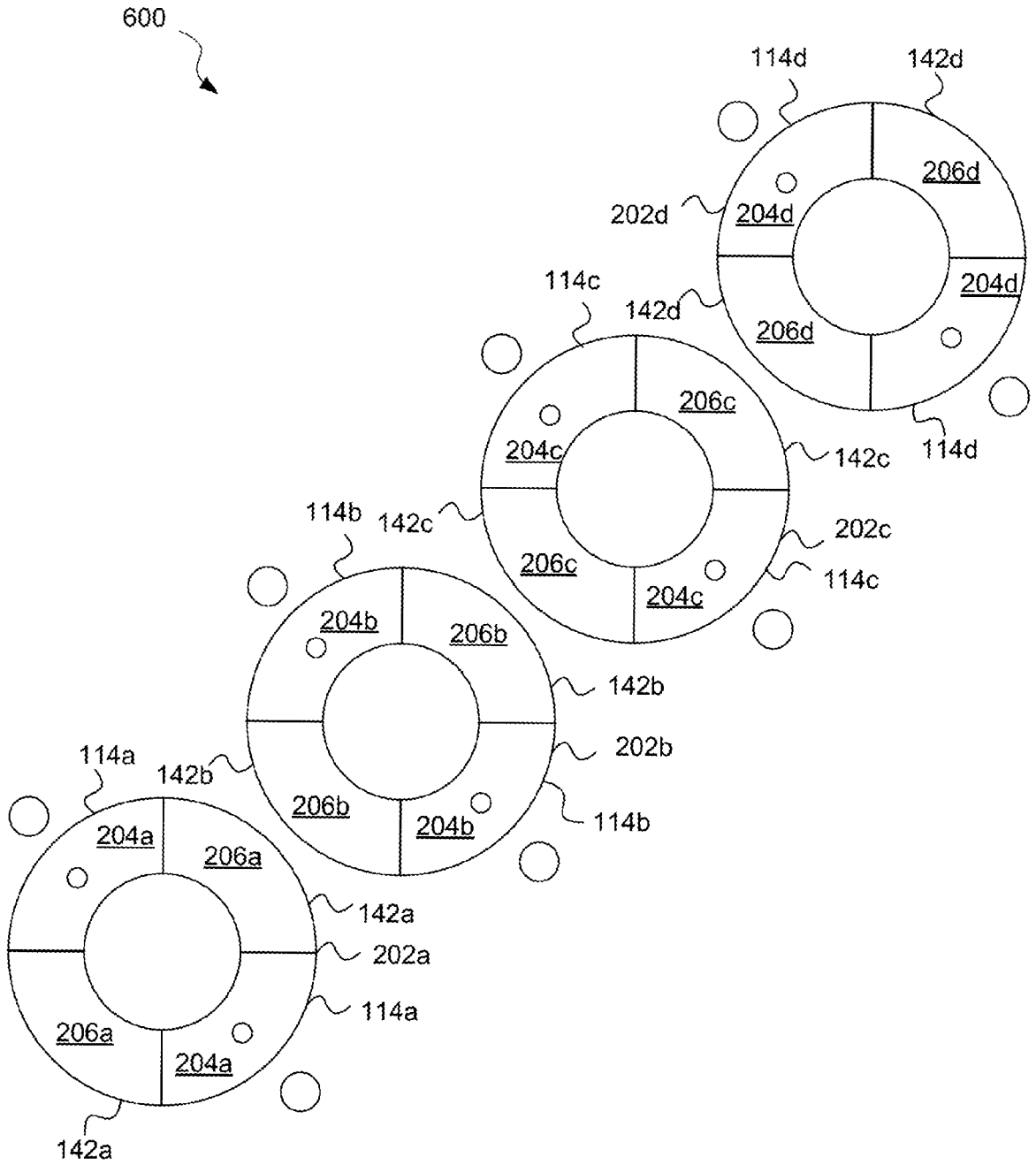
FIG. 6 is a top view diagram of a heater system including a plurality of burner systems of FIG. 5, according to an embodiment.

FIG. 6 is a top view diagram of a heater system 600 including a plurality of burner systems 500 of FIG. 5, according to an embodiment. The arrangements of FIG. 5 and FIG. 6 may be useful for providing plural burners in a heating system 600 that arranges the burners in a line. Instances of the plural third gas conduits 142*a* in a first burner system 500 of the plurality of burner systems may be arranged to be adjacent to one or more instances of the third gas conduits 142*b*, 142*c*, 142*d* of respective other burner systems 500 of the plurality of burner systems in the heater system 600. The plural second conduits 114 of each burner system 500 may face away from the line of burner systems.

The effect of this arrangement is similar to that of the system of FIG. 4 in that the main combustion reactions are somewhat separated or directed away from one another, which has been found to result in reduced oxides of nitrogen production.

Figure 7A:
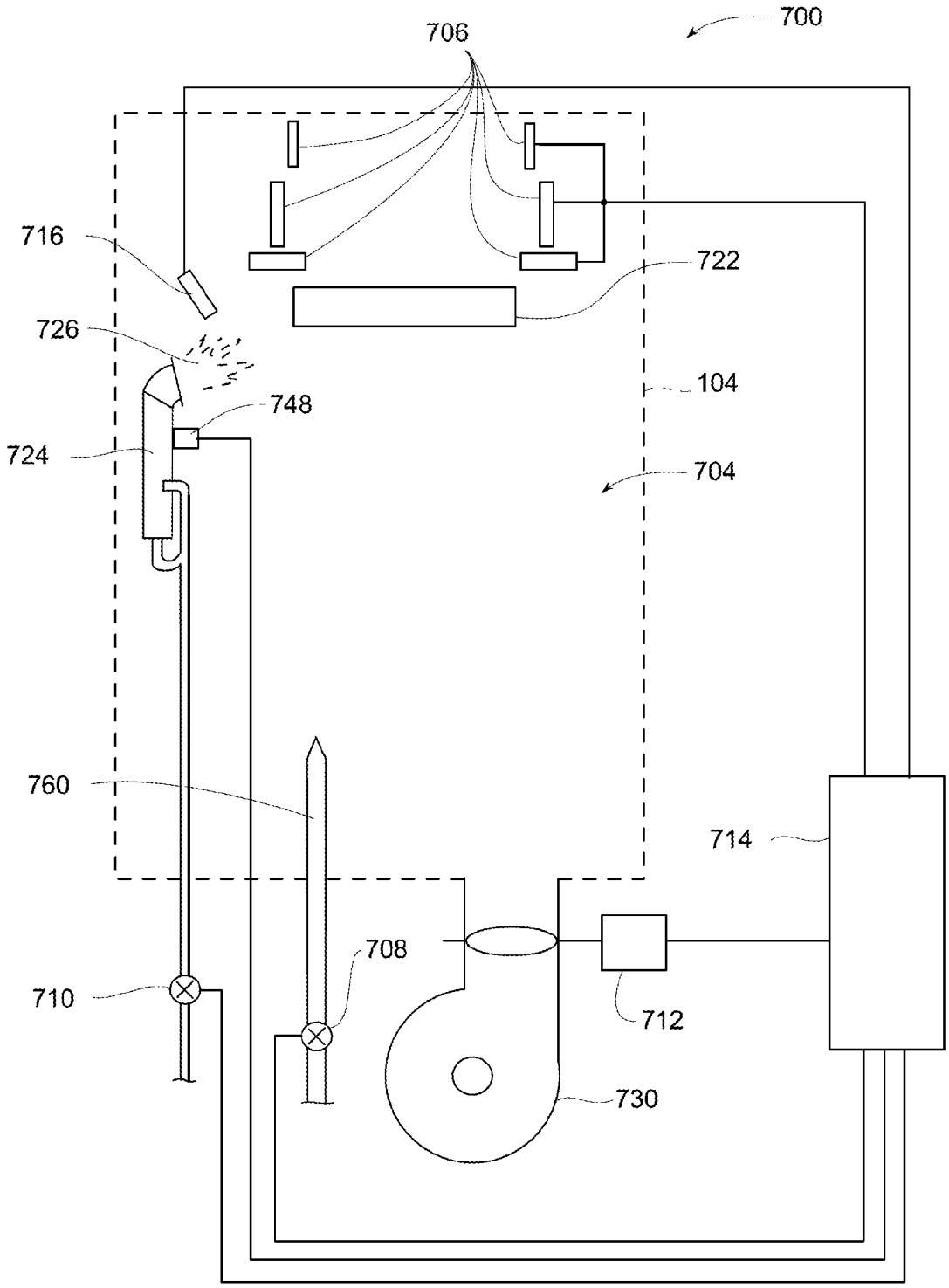
FIG. 7A is a diagram showing a combustion system, according to an embodiment.

FIG. 7A illustrates a combustion system 700, according to an embodiment including a combustion air source 730 configured to output combustion air (e.g., combustion air 128) into a furnace volume 704 and a pilot burner 724 such as the pre-mix pilot burner 124 described above, configured to pre-mix pilot fuel (e.g., 158) and oxidant (e.g., pre-mix combustion air 156) to support a pilot pre-mixed flame 726 (such as pre-mix pilot flame 126) during at least one operation state. The combustion system 700 may also include a main fuel nozzle 760 (such as first fuel nozzle 160) configured to output a main fuel into the furnace volume 704 from a proximal position during a standard operating state at least after the preheating state is complete and a distal flame holder 722 (such as the distal flame holder 122) positioned in the furnace volume 704 to be preheated by the pilot pre-mixed flame 726 during the preheating state and to hold a combustion reaction (such as combustion reaction 140) of the main fuel and oxidant adjacent to the distal flame holder 722 during the standard operating state. In addition, the combustion system 700 may also include one or more combustion sensors 706 configured to sense a condition of the distal flame holder 722 and to generate a sensor signal indicative of the condition of the distal flame holder 722; an actuator 708 configured to adjust a flow of the main fuel from the main fuel nozzle 760; an actuator 710 to adjust a flow of at least one of the pilot fuel and the oxidant to a pre-mix volume (such as pilot combustion air and fuel mixing volume 168) of the pilot burner; and an actuator 712 to adjust a flow of the oxidant from the combustion air source 730. A controller 714 may be communicatively coupled to the one or more actuators 708, 710, 712 and the combustion sensor 706, and the controller 714 may be configured to receive the sensor signal from the combustion sensor 706 and to control the one or more actuators 708, 710, 712 to adjust the flow of the pilot fuel, the main fuel, and/or the oxidant responsive to the sensor signal and in accordance with software instructions stored in a non-transitory computer readable medium coupled to the controller 714.

The controller 714 may also be coupled to a pilot flame sensor 716 that may be configured to sense a condition of the pilot pre-mixed flame 726 and to output to the controller 714 a sensor signal indicative of the condition of the pilot pre-mixed flame 726. The combustion sensor(s) 706 may, in an embodiment, include the pilot flame sensor 716. The pilot flame sensor 716 may include an electrocapacitive sensor.

In an embodiment, the controller 714 may be configured to control one or more of the actuators 708, 710, 712 to cause an igniter 748 (such as the igniter 148) to ignite the pilot pre-mixed flame 726 if the electrocapacitive sensor 716 indicates that the pilot pre-mixed flame 726 is not present and all safety interlocks are satisfied. The pilot flame sensor 716 may include an electro-resistive sensor and/or a tomographic sensor. The controller 714 may be configured to adjust a size of the pilot pre-mixed flame 726 in response to the sensor signals from at least the combustion sensor 706 by controlling one or more of the actuators 708, 710, 712 to adjust the flow of the pilot fuel and/or the pilot oxidant. The combustion sensor 706 may be further configured to detect the combustion reaction at the distal flame holder 722 and to output sensor signals to the controller 714 responsive to a detected state of the combustion reaction. The combustion sensor 706 may include an electrocapacitive sensor.

In an embodiment, the electrocapacitive sensor 706 may include a first set of electrodes positioned laterally around the distal flame holder 722; this is exemplified in FIG. 7A by the electrode 706 including portions or electrodes on either side of the distal flame holder 722. The electrocapacitive sensor 706 may be configured to sense a parameter in a vicinity of the distal flame holder 722, and optionally may further include a second set of electrodes 706 positioned upstream from the distal flame holder 722 as shown in FIG. 7A and may be configured to sense a parameter upstream from the distal flame holder 722, and the controller 714 may sense the combustion reaction by comparing a parameter sensed by the first set of electrodes to a parameter sensed by the second set of electrodes. In an embodiment, the first set of electrodes are part of the combustion sensor 706. In an embodiment, the second set of electrodes positioned upstream from the distal flame holder 722 may be configured to detect flashback by sensing a parameter upstream from the distal flame holder 722.

In an embodiment, the plurality of electrodes 706 may include one or more first pairs of electrodes separated from each other by the distal flame holder 722 and disposed opposite each other in a first orientation substantially perpendicular to a primary direction of a flow of the main fuel toward the distal flame holder 722, as shown in FIG. 7A. In such a configuration, the plurality of electrodes 706 may include one or more second pairs of electrodes 706 separated from each other by the distal flame holder 722 and disposed opposite each other in a second orientation substantially perpendicular to both the first orientation and the primary direction of the flow of the main fuel.

Figure 7B:
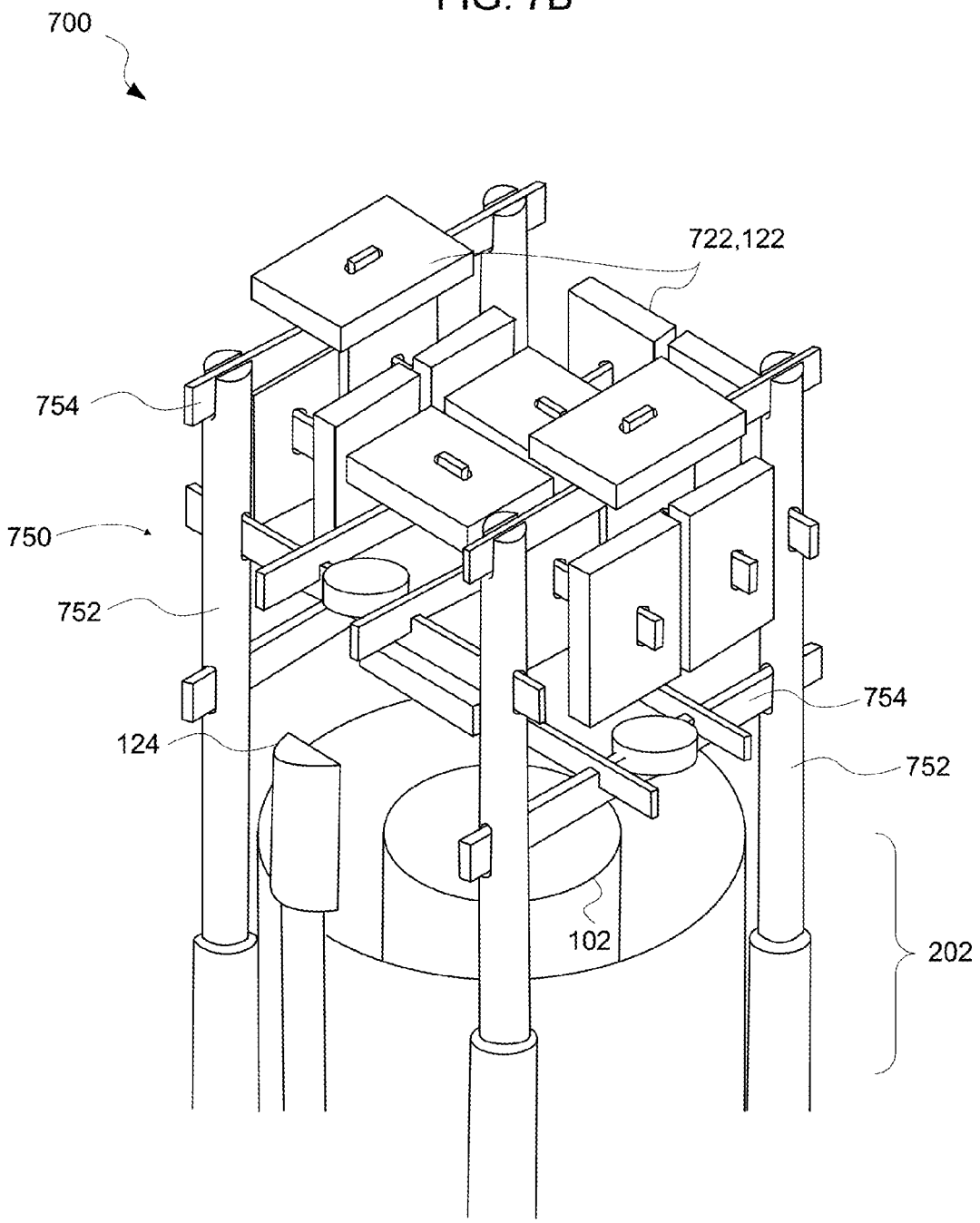
FIG. 7B is a perspective view of a portion of the combustion system of FIG. 7A illustrating a distal flame holder, according to an embodiment.

FIG. 7B is a perspective view of a portion of the burner system 700 illustrating a distal flame holder 122, 722, according to an embodiment. The distal flame holder 122, 722 may include a bluff body. For example, the bluff body may include at least one solid refractory body. In another embodiment, the distal flame holder 122, 722 includes at least one gutter-type flame holder. In another embodiment, the distal flame holder 122, 722 includes a plurality of silicon carbide slats.

Additionally, or alternatively, the distal flame holder 122, 722 may include at least one perforated tile. Additionally or alternatively, the distal flame holder 122, 722 may include at least one metal body. According to an embodiment the distal flame holder 722 may be positioned so that at least a portion of the distal flame holder 122, 722 is cooled by a flow of at least the first gas mixture while also holding the main combustion reaction. As shown in FIG. 7B, the distal flame holder 122, 722 may include an asymmetric arrangement of a plurality of bluff body tiles. As shown, the pre-mix pilot burner 724 may output a pilot flame (e.g., 726) through a low solid body or open side. This arrangement has been found to provide a good combination of stability for asymmetric main combustion reactions 140, such as those resulting from the configuration shown in FIG. 3. The burner system 700 may further include a support structure 750 exemplified by support legs 752 supporting the distal flame holder 122, 722 in the furnace 104, shown in FIG. 7A in dashed lines. In an embodiment, the support structure 750 may include cross members 754 that may be disposed and oriented to support one or more elements of the distal flame holder 122, 722.

Figure 7C:
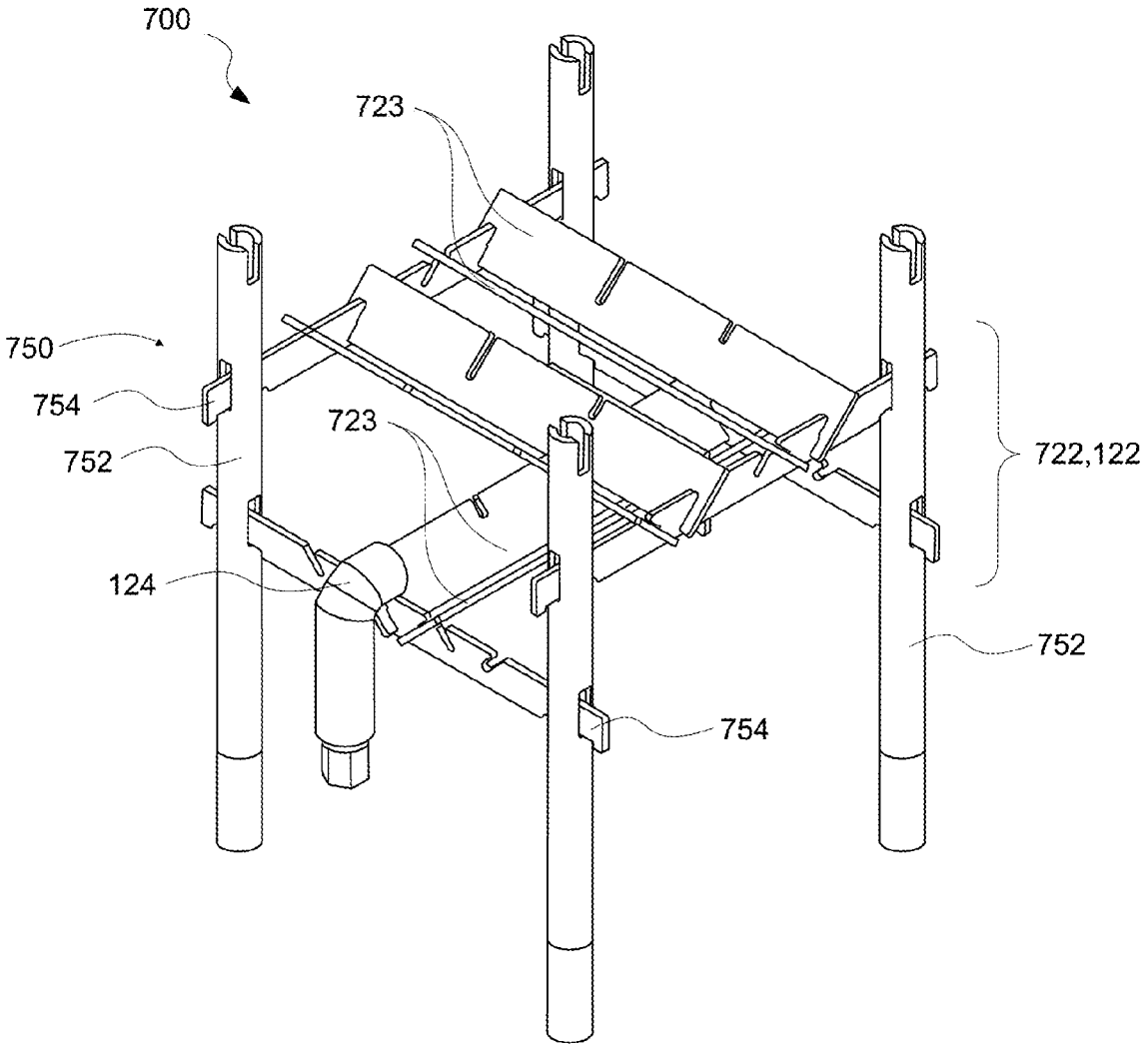
FIG. 7C is a perspective view of a portion of the burner system 700 illustrating a distal flame holder, according to an embodiment.

FIG. 7C is a perspective view of a portion of the burner system 700 illustrating a distal flame holder 122, 722 of FIG. 7C, according to an embodiment. Each cross member 754 may be formed to support a distal flame holder 122, 722 comprising one or more pairs of slats 723. According to an embodiment the cross members 754 may include slots to receive the slats 723. The slats may be formed from silicone carbide or, alternatively, zirconia. Each of the one or more pairs of slats 723 may be oriented roughly in a V-shape disposed longitudinally across the support structure 750. In some embodiments the distal flame holder 722, 122 may include multiple layers of slats. For example, FIG. 7C shows two layers of slats. Those having skill in the art will recognize that fewer or more layers of slats 723 may be employed. According to an embodiment multiple sets of slats may be included to permit varying the distance between pairs of slats 723.

Figure 7D:
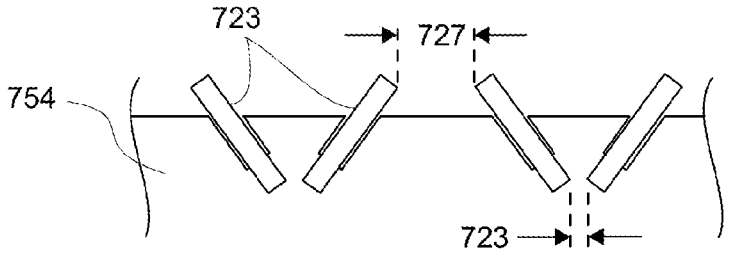
FIG. 7D is an end view of the distal flame holder of FIG. 7C, according to the embodiment having one or more pairs of slats 723.

FIG. 7D is an end view of the distal flame holder 122, 722 according to the embodiment having one or more pairs of slats 723. The cross member 754 may include one or more v-shaped cut-outs configured to hold an end of a pair of the slats 723. A gap may, in some embodiments, be formed in the bottom of the V. In embodiments including plural pairs of the slats 723, the v-shaped cut-outs may be spaced. At least one of the gap(s) and the space(s) permit flow of the first gas mixture 104 therethrough. The cross members 754 may alternatively include v-shaped recesses onto which pairs of slats 723 may be lain. In such embodiments, no gap is required.

Figure 8:
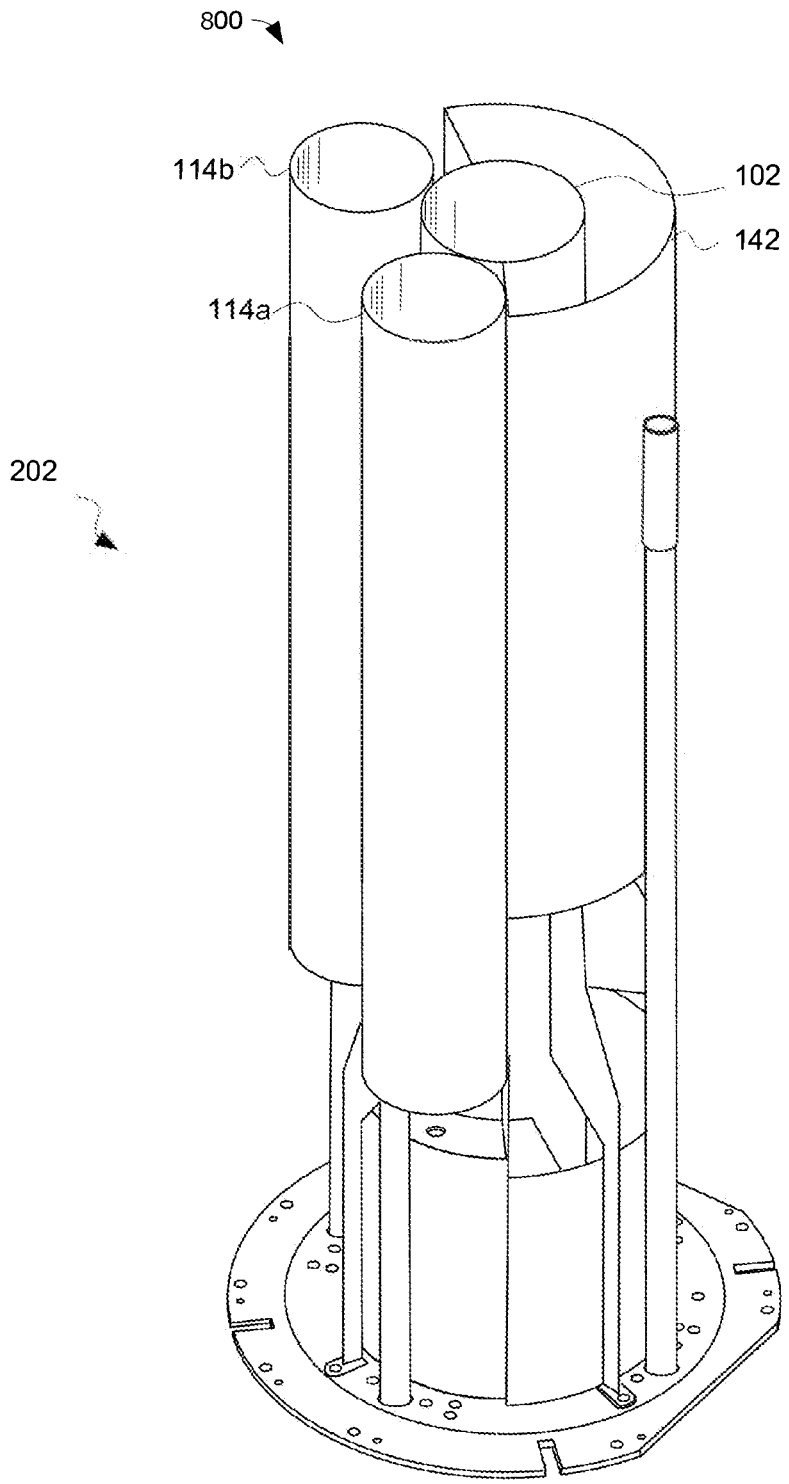
FIG. 8 is diagram of a gas duct assembly, according to an embodiment.

FIG. 8 is diagram of a gas duct assembly 202, according to an embodiment 800. In the embodiment 800 of FIG. 8, the second gas duct includes two gas ducts 114*a*, 114*b*. The first gas duct 102 is disposed adjacent to the two second gas ducts 114*a*, 114*b*. In the embodiment 800, a third gas duct 142 is disposed adjacent to the first gas duct 102, as a portion of an annular region around a wall of the first gas duct 102. The third gas duct 142 may additionally or alternatively be disposed adjacent to the two second gas ducts 114*a*, 114*b*.

Ordinal numbers, e.g., first, second, third, etc., are used in the claims according to conventional claim practice, i.e., for the purpose of clearly distinguishing between claimed elements or features thereof, etc. (hereafter, elements), without imposing specific additional limitations on those elements. Ordinal numbers may be assigned arbitrarily, or in the order in which the numbered elements are introduced, etc. The use of such numbers, alone, does not suggest any other relationship, such as order of operation, relative position of such elements, etc. Furthermore, an ordinal number used to refer to an element in a claim should not be assumed to correlate to a number used in the specification to refer to an element of a disclosed embodiment on which that claim reads, nor to numbers used in unrelated claims to designate similar elements or features.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A method for operating a burner system comprising:

mixing a gaseous fuel with flue gas as the gaseous fuel and flue gas travel from a proximal position to a distal position in a first mixing tube;

providing a flow of combustion air through a second mixing tube to a distal position in the second mixing tube;

igniting the gaseous fuel and combustion air with a distal pilot burner; and holding a combustion reaction of the gaseous fuel and combustion air with a distal flame holder positioned to receive the flow of fuel and flue gas and the flow of combustion air at the distal position.

2. The method for operating the burner system of claim 1, wherein mixing the gaseous fuel with flue gas includes mixing the gaseous fuel with flue gas including less than a concentration of oxygen necessary to support combustion.

3. The method for operating the burner system of claim 1, wherein mixing the gaseous fuel with flue gas includes entraining the flue gas into a proximal end of the first mixing tube.

4. The method for operating the burner system of claim 3, wherein an atmosphere in a furnace at the proximal position consists essentially of the flue gas; and wherein entraining the flue gas into the proximal end of the first mixing tube includes supporting the proximal end of the first mixing tube inside the furnace.

5. The method for operating the burner system of claim 1, wherein providing the flow of combustion air to the distal position includes providing a flow of combustion air including less than a concentration of fuel necessary to support combustion.

6. The method for operating the burner system of claim 1, wherein providing the flow of combustion air through the second mixing tube to the distal position includes providing a flow of flue gas mixed with the combustion air.

7. The method for operating the burner system of claim 1, wherein providing the flow of combustion air through the second mixing tube to the distal position includes conveying the combustion air through the second mixing tube from an inlet outside of a furnace volume to the distal position.

8. The method for operating the burner system of claim 1, wherein the conduit ses a second mixing tube is, substantially parallel to the first mixing tube.

9. The method for operating the burner system of claim 1, wherein the second mixing tube is configured to entrain flue gas into the combustion air flow and mix the flue gas with the combustion air such that providing a flow of combustion air through the second mixing tube to the distal position includes providing a flow of combustion air mixed with flue gas through the second mixing tube to the distal position.

10. The method for operating the burner system of claim 1, wherein the fuel and combustion air reach a reaction stoichiometry sufficient to support combustion only at and downstream from a fuel dump plane coincident with a downstream end of the first mixing tube.

11. The method for operating the burner system of claim 1, further comprising:

premixing a pilot fuel and pilot combustion air;

wherein igniting the gaseous fuel and combustion air at the distal position with a distal pilot burner includes igniting the gaseous fuel and combustion air with a premixed fuel pilot burner.

12. The method for operating the burner system of claim 1, wherein holding the combustion reaction of the gaseous fuel and combustion air with the distal flame holder positioned to receive the flow of fuel and flue gas and the flow of combustion air at the distal position includes holding the combustion reaction with a distal flame holder comprising a non-metallic structure.

13. The method for operating the burner system of claim 1, wherein holding the combustion reaction of the gaseous fuel and combustion air with the distal flame holder positioned to receive the flow of fuel and flue gas and the flow of combustion air at the distal position includes holding the combustion reaction with a distal flame holder comprising a perforated flame holder.

14. The method for operating the burner system of claim 1, wherein holding the combustion reaction of the gaseous fuel and combustion air with the distal flame holder positioned to receive the flow of fuel and flue gas and the flow of combustion air at the distal position includes holding the combustion reaction with a distal flame holder comprising a V-gutter flame holder.

15. The method for operating the burner system of claim 14, wherein holding the combustion reaction with a distal flame holder comprising a V-gutter flame holder includes holding the combustion reaction with a V-gutter flame holder formed as two ceramic slats held at a non-zero angle to one another with a ceramic cross-members.

16. The method for operating the burner system of claim 14, wherein holding the combustion reaction with a distal flame holder comprising a V-gutter flame holder includes holding the combustion reaction with a V-gutter formed as two silicon carbide slats.

17. An industrial burner, comprising:

a first mixing tube configured to carry flue gas and fuel to a fuel dump plane;

a second mixing tube configured to carry combustion air to the fuel dump plane;

a distal flame holder disposed to receive the flue gas, fuel, and combustion air from the first mixing tube and the conduit, and to hold a combustion reaction thereof; and a distal pilot burner configured to cause ignition of the combustion reaction.

18. The industrial burner of claim 17, wherein the flue gas and fuel carried by the first mixing tube has an oxygen concentration too low to support combustion of the fuel.

19. The industrial burner of claim 17, wherein the first mixing tube defines an inlet end inside a furnace and an outlet end defining the fuel dump plane; and wherein a flow of the fuel into the first mixing tube is configured to entrain the flue gas into the inlet end of the mixing tube; and wherein the mixing tube has a length sufficient to cause complete mixing of the fuel and flue gas as the fuel and flue gas flow to the outlet end of the first mixing tube.

20. The industrial burner of claim 17, wherein the second mixing tube is arranged to prevent an entry of fuel into the air conduit at a concentration sufficient to support a combustion reaction while the combustion air is in the second mixing tube.

21. The industrial burner of claim 17, wherein the second mixing tube is configured to admit flue gas to at least partially mix with the combustion air prior to output of the combustion air at the fuel dump plane.

22. The industrial burner of claim 17, further comprising:

an air register disposed outside a furnace volume and operatively coupled to the second mixing tube, the air register being configured to receive natural draft combustion air and provide the natural draft combustion air to the second mixing tube.

23. The industrial burner of claim 17, further comprising:

a blower operatively coupled to the second mixing tube, the blower being configured to provide forced draft combustion air to the second mixing tube.

24. The industrial burner of claim 17, wherein the first mixing tube and the second mixing tube are configured to provide a ratio of fuel to oxygen configured to support combustion at a distal location coincident with the flame holder and to prevent mixing of fuel and oxygen prior to output at the fuel dump plane.

25. The industrial burner of claim 17, wherein the distal pilot burner comprises a premixed fuel pilot burner.

26. The industrial burner of claim 17, wherein the distal flame holder includes one or more perforated non-metallic tiles configured to hold the combustion reaction.

27. The industrial burner of claim 17, wherein the distal flame holder includes a V-gutter defined by a pair of oppositely-inclined ceramic slats.

28. The industrial burner of claim 27, wherein the distal flame holder includes a plurality of ceramic cross-members including slots configured to receive and hold the pair of oppositely-inclined ceramic slats.

29. The industrial burner of claim 17, wherein the distal flame holder includes a structure formed from silicon carbide, zirconia, or silicon carbide and zirconia.

30. The industrial burner of claim 17, wherein the second mixing tube is substantially parallel to the first mixing tube.

31. An industrial burner, comprising:

a first mixing tube configured to carry flue gas and fuel to a fuel dump plane;

an air conduit configured to carry combustion air to the fuel dump plane;

a distal flame holder disposed to receive the flue gas, fuel, and combustion air from the first mixing tube and the conduit, and to hold a combustion reaction thereof; and a distal pilot burner configured to cause ignition of the combustion reaction, wherein the first mixing tube and the air conduit are configured to provide a ratio of fuel to oxygen configured to support combustion at a distal location coincident with the flame holder and to prevent mixing of fuel and oxygen prior to output at the fuel dump plane.

32. The industrial burner of claim 31, wherein the flue gas and fuel carried by the first mixing tube has an oxygen concentration too low to support combustion of the fuel.

33. The industrial burner of claim 31, wherein the first mixing tube defines an inlet end inside a furnace and an outlet end defining the fuel dump plane; and wherein a flow of the fuel into the first mixing tube is configured to entrain the flue gas into the inlet end of the mixing tube; and wherein the mixing tube has a length sufficient to cause complete mixing of the fuel and flue gas as the fuel and flue gas flow to the outlet end of the first mixing tube.

34. The industrial burner of claim 31, wherein the air conduit is arranged to prevent an entry of fuel into the air conduit at a concentration sufficient to support a combustion reaction while the combustion air is in the air conduit.

35. The industrial burner of claim 31, wherein the air conduit comprises a second mixing tube; and wherein the second mixing tube is configured to admit flue gas to at least partially mix with the combustion air prior to output of the combustion air at the fuel dump plane.

36. The industrial burner of claim 31, further comprising:

an air register disposed outside a furnace volume and operatively coupled to the combustion air conduit, the air register being configured to receive natural draft combustion air and provide the natural draft combustion air to the air conduit.

37. The industrial burner of claim 31, further comprising:

a blower operatively coupled to the air conduit, the blower being configured to provide forced draft combustion air to the air conduit.

38. The industrial burner of claim 31, wherein the distal pilot burner comprises a premixed fuel pilot burner.

39. The industrial burner of claim 31, wherein the distal flame holder includes one or more perforated non-metallic tiles configured to hold the combustion reaction.

40. The industrial burner of claim 31, wherein the distal flame holder includes a V-gutter defined by a pair of oppositely-inclined ceramic slats.

41. The industrial burner of claim 39, wherein the distal flame holder includes a plurality of ceramic cross-members including slots configured to receive and hold the pair of oppositely-inclined ceramic slats.

42. The industrial burner of claim 31, wherein the distal flame holder includes a structure formed from silicon carbide, zirconia, or silicon carbide and zirconia.

43. A burner system, comprising:

a first mixing tube configured to carry flue gas and fuel to a fuel dump plane;

an air conduit configured to carry combustion air to the fuel dump plane;

a distal flame holder comprising a V-gutter flame holder disposed to receive the flue gas, fuel, and combustion air from the first mixing tube and the conduit, and to hold a combustion reaction thereof; and a distal pilot burner configured to cause ignition of the combustion reaction.

44. The burner system of claim 43, wherein the flue gas and fuel carried by the first mixing tube has an oxygen concentration too low to support combustion of the fuel.

45. The burner system of claim 43, wherein the first mixing tube defines an inlet end inside a furnace and an outlet end defining the fuel dump plane; and wherein a flow of the fuel into the first mixing tube is configured to entrain the flue gas into the inlet end of the mixing tube; and wherein the mixing tube has a length sufficient to cause complete mixing of the fuel and flue gas as the fuel and flue gas flow to the outlet end of the first mixing tube.

46. The burner system of claim 43, wherein the air conduit is arranged to prevent an entry of fuel into the air conduit at a concentration sufficient to support a combustion reaction while the combustion air is in the air conduit.

47. The burner system of claim 43, wherein the air conduit comprises a second mixing tube; and wherein the second mixing tube is configured to admit flue gas to at least partially mix with the combustion air prior to output of the combustion air at the fuel dump plane.

48. The burner system of claim 43, further comprising:

an air register disposed outside a furnace volume and operatively coupled to the combustion air conduit, the air register being configured to receive natural draft combustion air and provide the natural draft combustion air to the air conduit.

49. The burner system of claim 43, further comprising:

a blower operatively coupled to the air conduit, the blower being configured to provide forced draft combustion air to the air conduit.

50. The burner system of claim 43, wherein the first mixing tube and the air conduit are configured to provide a ratio of fuel to oxygen configured to support combustion at a distal location coincident with the flame holder and to prevent mixing of fuel and oxygen prior to output at the fuel dump plane.

51. The burner system of claim 43, wherein the distal pilot burner comprises a premixed fuel pilot burner.

52. The burner system of claim 43, wherein the V-gutter is defined by a pair of oppositely-inclined ceramic slats.

53. The burner system of claim 52, wherein the distal flame holder includes a plurality of ceramic cross-members including slots configured to receive and hold the pair of oppositely-inclined ceramic slats.

54. The burner system of claim 43, wherein the distal flame holder includes a structure formed from silicon carbide, zirconia, or silicon carbide and zirconia.

55. The burner system of claim 43, wherein the second mixing tube is substantially parallel to the first mixing tube.

* * * * *